US006864453B1

(12) United States Patent
Yu

(10) Patent No.: US 6,864,453 B1
(45) Date of Patent: Mar. 8, 2005

(54) PROTECTION MECHANISM FOR SWITCH

(76) Inventor: Tsung-Mou Yu, No. 4, Alley 2, Lane 23, Sec. 3, Pa Te Road, Panchiao City, Taipei Hsien (TW)

( * ) Notice: Subject to any disclaimer, the term of this patent is extended or adjusted under 35 U.S.C. 154(b) by 0 days.

(21) Appl. No.: 10/887,655

(22) Filed: Jul. 8, 2004

(51) Int. Cl.[7] ..... H01H 13/14
(52) U.S. Cl. ..... 200/520; 200/553; 337/66
(58) Field of Search ..... 200/520–525, 200/529–535, 334; 337/36, 37, 56, 62, 66, 85, 113

(56) References Cited

U.S. PATENT DOCUMENTS 4,167,720 A 9/1979 Krasser ..... 337/60
4,937,548 A 6/1990 Sdunek ..... 337/70
5,223,813 A 6/1993 Cambreleng et al. ..... 337/66
5,262,748 A 11/1993 Tsung-Mou ..... 337/66
5,451,729 A 9/1995 Onderka et al. ..... 200/18
5,558,211 A 9/1996 Heydner et al. ..... 200/553
6,335,500 B1 * 1/2002 Chi et al. ..... 200/341
6,400,250 B1 * 6/2002 Wang ..... 337/66
6,483,416 B2 * 11/2002 Yu ..... 337/126
6,552,644 B2 * 4/2003 Yu ..... 337/66
6,674,033 B1 * 1/2004 Wang ..... 200/334
6,717,085 B2 * 4/2004 Wang ..... 200/520
6,800,826 B1 * 10/2004 Yu ..... 200/520

* cited by examiner

*Primary Examiner*—Michael A. Friedhofer

(57) ABSTRACT

A protection mechanism for a switch device includes a disk rotatably connected to an inside of the case and two ends of a pull member are pivotably connected between the disk and the switch member pivotably connected to an open top of the case. One of the two ends of the pull member lifts the bimetallic plate to set the "OFF" status when pivoting the switch member. A push member has one end movably engagged with an upward groove in an inside of the case so as to push the bimetallic plate to contact one of two terminals, and the other end of the push member is pivotably connected to the disk. The push member is pivoted an angle to produce a space between the push member and the bimetallic plate when the switch member is pivoted to "ON" position and the space allows the bimetallic plate to be completely deformed when overload.

7 Claims, 4 Drawing Sheets

(OFF)

(OFF)

(ON)

PROTECTION MECHANISM FOR SWITCH

FIELD OF THE INVENTION

The present invention relates to a protection mechanism for a switch device and provides a space allowing the bimetallic plate to be completely deformed when overload.

BACKGROUND OF THE INVENTION

The conventional circuit breaker uses a fuse between the switch and the circuit such that when there is an electrical overload, the fuse will first melt before the overload causes damages. However, if the fuse is not properly installed or an improper fuse is used the overload current cannot melt the fuse and a disaster can be resulted. U.S. Pat. Nos. 5,262,748, 4,167,720, 4,937,548, 5,223,813, 5,451,729, and 5,558,211 disclose different types of circuit breakers which commonly include a complicated mechanism to drive the bimetallic plate which is expected to be deformed and bent when overload in current. Nevertheless, it is noted that the bimetallic plate does not completely deformed as desired because it is not passable to freely deformed, and is still in contact with the terminal so that sparks could be produced and therefore cause disaster.

Therefore, it is desired to have a protection mechanism for a switch device that includes a push member for pushing the bimetallic plate to its "ON" position and the push member can only be rotated in one direction which produces a space to allow the bimetallic plate to be completely deformed when the current is overload so as to resolve the shortcomings of the conventional switch devices.

SUMMARY OF THE INVENTION

In accordance with an aspect of the present invention, there is provided a switch device that comprises a case having an open top for a switch member pivotably engaged therewith. A first terminal and a second terminal respectively extend through a bottom of the case. A bimetallic plate has a first end fixed to the first terminal and a first contact point is connected to a second end of the bimetallic plate. A second contact point is connected to the second terminal and located beneath the first contact point. A protection mechanism includes a pull member and a push member. The pull member has an upper end pivotably connected to a connection port of the switch member, and a hook portion at a lower end thereof so as to lift the second end of the bimetallic plate to set the switch to "OFF" status. The push member is located above the bimetallic plate and pivotably connected to the pull member such that the push member can push the second end of the bimetallic plate to set the switch to "ON" status, and be pivoted an angle to produce a space between the push member and the second end of the bimetallic plate in the "ON" status.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
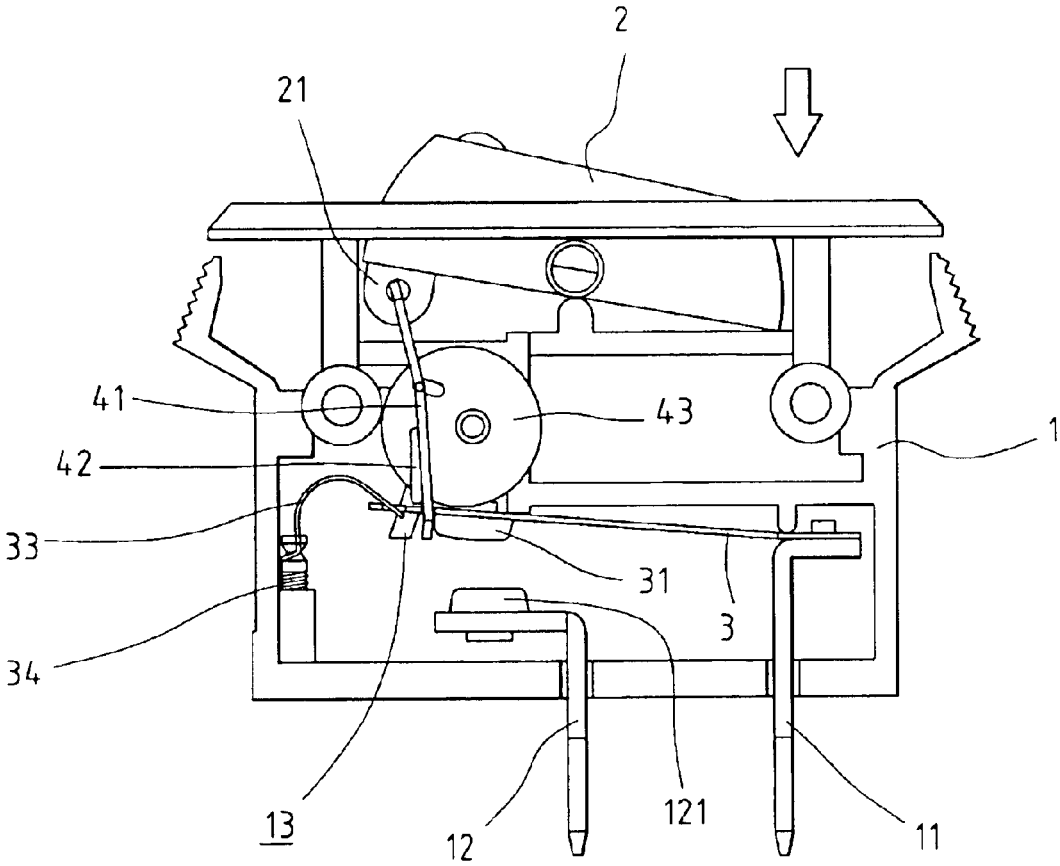
FIG. 1 shows the "OFF" status of the switch device of the present invention.
Figure 2:
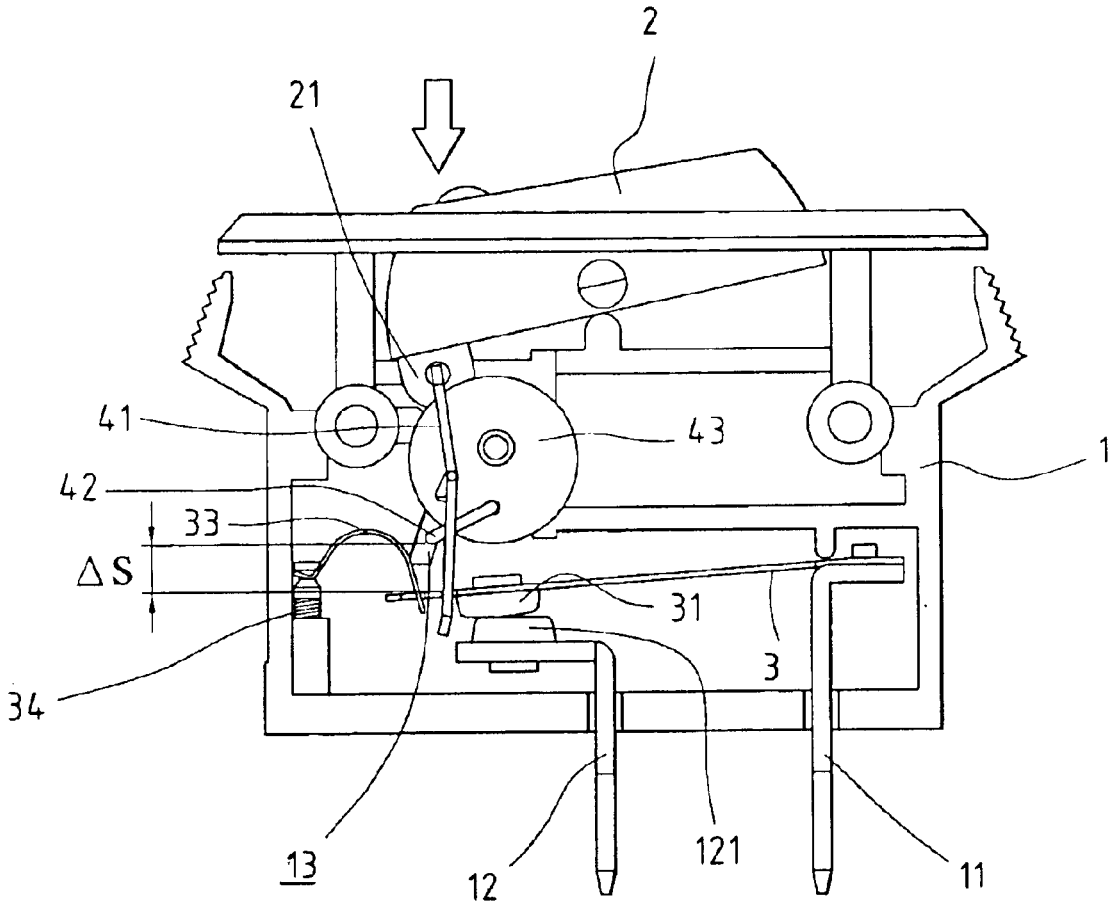
FIG. 2 shows the "ON" status of the switch device of the present invention.
Figure 4:
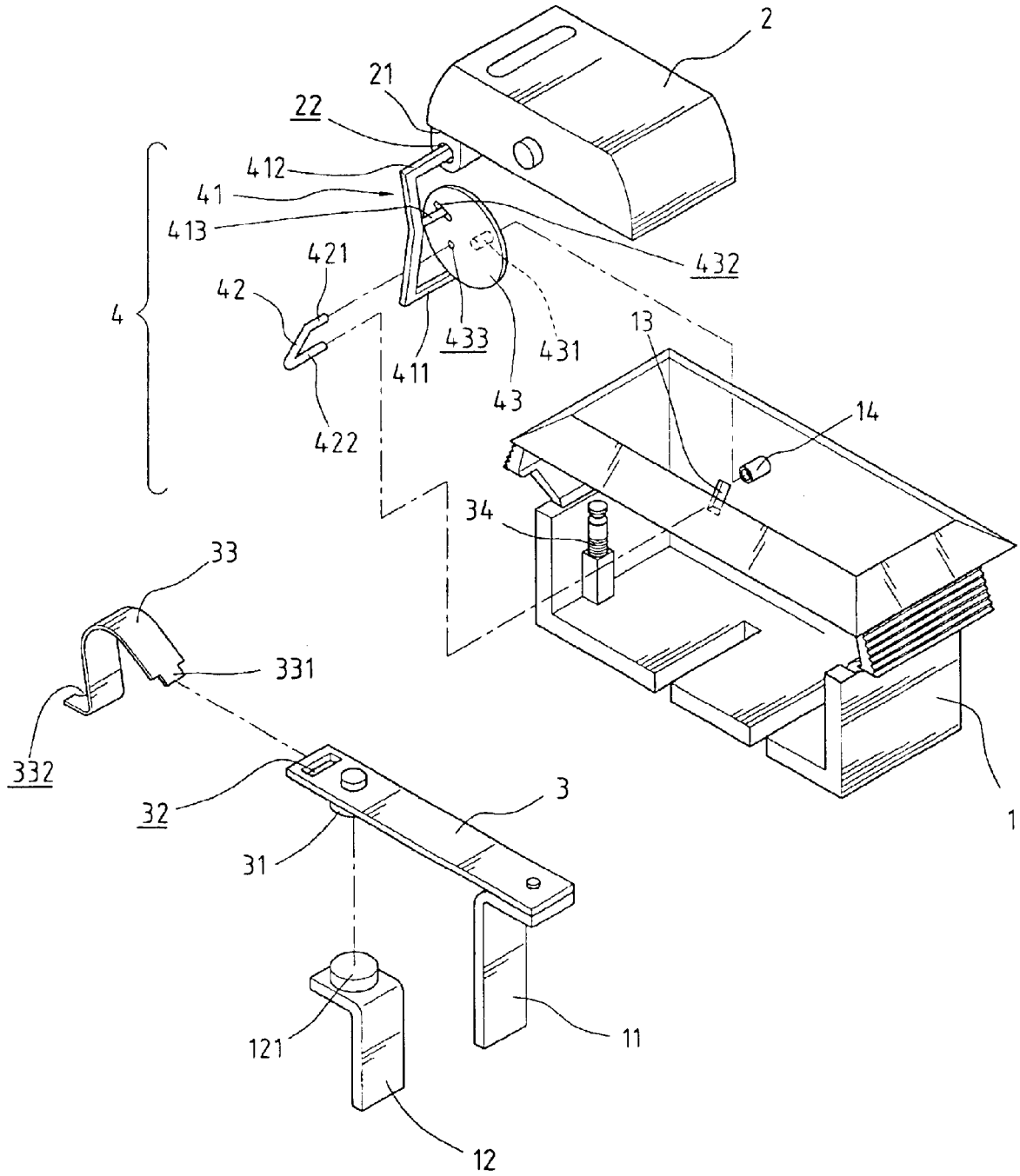
FIG. 4 is an exploded view to show the protection mechanism of the present invention.

Referring to the drawings and in particular FIGS. 1, 2 and 4, a switch device comprises a case 1 having an open top and a switch member 2 is pivotably engaged with the open top of the case 1 so as to be pushed either one of two ends thereof. A connection port 21 is connected to an underside of the switch member 2 and includes a hole 22. A first terminal 11 and a second terminal 12 respectively extend through a bottom of the case 1. A bimetallic plate 3 has a first end fixed to the first terminal 11 and a first contact point 31 is connected to a second end of the bimetallic plate 3. A second contact point 121 is connected to the second terminal 12 and located beneath the first contact point 31. A groove 13 is defined in an inside thereof and a tube 14 extends from the inside of the case 1, the groove 13 oriented upward.

A block is connected to an inside of the case 1 and an adjusting bolt 34 is threadedly connected to the block. A curve flexible plate 33 has a notch 332 defined in a first end thereof and the adjusting bolt 34 is engaged with the notch 332. A second end of the flexible plate 33 includes an insertion 331 that is engaged with a through hole 32 of the second end of the bimetallic plate 3. The flexible plate 33 provides a force to assist the deformation of the bimetallic plate 3.

A protection mechanism 4 includes a pull member 41 that has a hook portion 411 at a lower end thereof and an upper end 412 of the pull member 41 is a rod that is pivotably inserted in the hole 22 of the connection port 21. The second end of the bimetallic plate 3 is located above the hook portion 411. A disk 43 has a shaft 431 extending eccentrically from one of two opposite surfaces of the disk 43 and inserted in the tube 14. A protrusion 413 extends from a mediate portion of the pull member 41 and is pivotably engaged with a slot 432 defined in the disk 43. A push member 42 is located above the bimetallic plate 3 and has a first end 421 that is pivotably inserted in a reception hole 433 defined in the disk 43 and a second end 422 of the push member 42 is movably inserted in the groove 13.

When pushing the left end of the switch member 2 downward, the pull member 41 is lowered and the disk 43 is rotated so as to lower the push member 42. The second end 422 of the push member 42 pushes the second end of the bimetallic plate 3 so that the first and second contact points 31, 121 are in contact with each other. This sets the switch to "ON" status as shown in FIG. 2. It is noted that a space $\Delta S$ is formed between the second end of the push member 42 and the second end of the bimetallic plate 3. When pushing the right end of the switch member 2 downward, the hook portion 411 of the pull member 41 is lifted so as to lift the second end of the bimetallic plate 3, the first and second contact points 31, 121 are then separated from each other. This sets the switch to "OFF" status as shown in FIG. 1.

Figure 3:
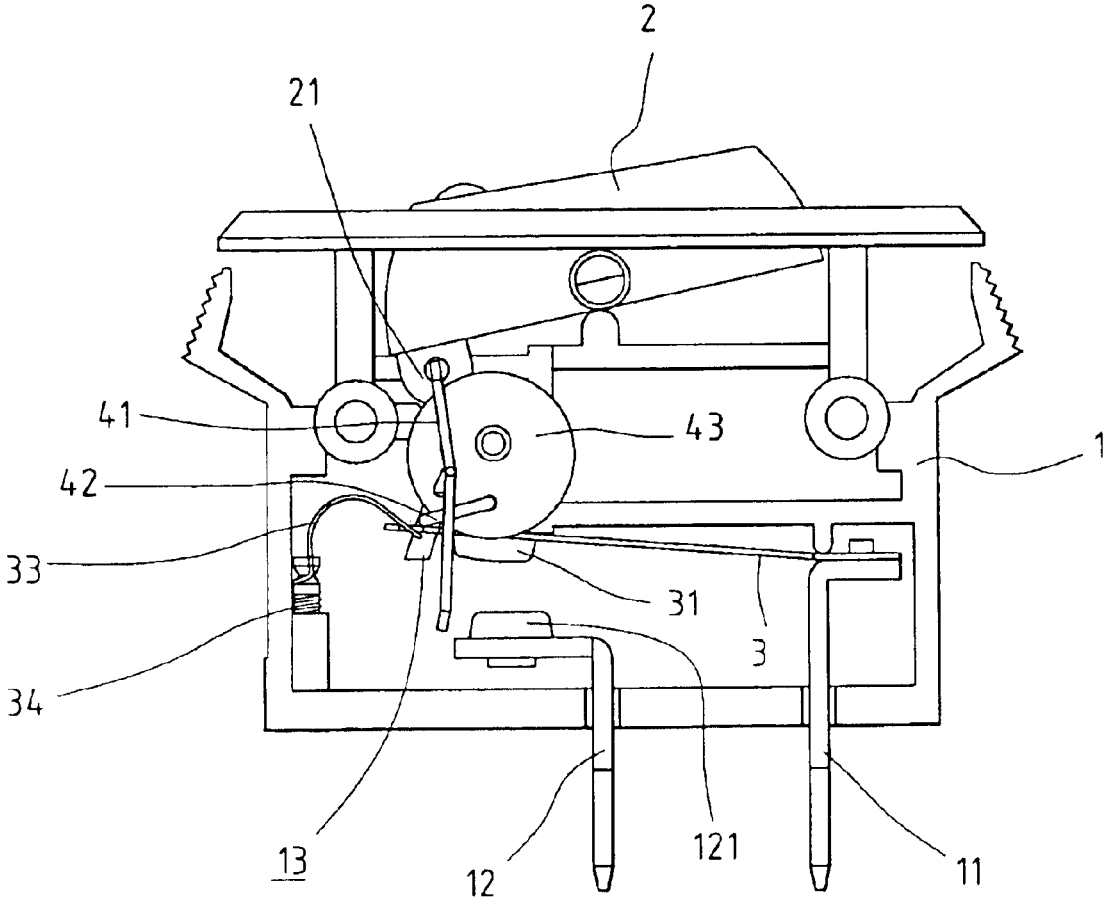
FIG. 3 shows the bimetallic plate is deformed upward and the push member is pivoted angle to allow the bimetallic plate to be completely deformed when overload.

As shown in FIG. 3, when overload while the switch device is in "ON" status, the second end of the bimetallic plate 3 is deformed upward and hits the second end 422 of the push member 42. Because of the inclination of the groove 13, the second end 422 of the push member 42 is moved clockwise in the groove 13 and the space $\Delta S$ allows the bimetallic plate 3 to be completely deformed.

While we have shown and described the embodiment in accordance with the present invention, it should be clear to those skilled in the art that further embodiments may be made without departing from the scope of the present invention.

What is claimed is:

1. A switch device comprising:

a case having an open top and a switch member pivotably engaged with the open top of the case, a connection port connected to the switch member;

a first terminal and a second terminal respectively extending through a bottom of the case, a bimetallic plate having a first end fixed to the first terminal and a first contact point connected to a second end of the bimetallic plate, a second contact point connected to the second terminal and located beneath the first contact point, and a protection mechanism including a pull member which has a hook portion at a lower end thereof and an upper end of the pull member pivotably connected to the connection port of the switch member, the second end of the bimetallic plate located above the hook portion, a push member located above the bimetallic plate and pivotably connected to the pull member, the push member capable of being pivoted an angle to produce a space between the push member and the second end of the bimetallic plate when the switch member is pivoted to "ON" position.

2. The device as claimed in claim 1, wherein the connection port includes a hole and the upper end of the pull member inserted into the hole.

3. The device as claimed in claim 1, wherein the case includes a groove defined in an inside thereof and a tube extends from the inside of the case, the groove oriented upward, a protrusion extending from a mediate portion of the pull member and pivotably engaged with a slot defined in a disk which has an shaft inserted in the tube, the push member having a first end which is pivotably inserted in reception hole defined in the disk and a second end which is movably inserted in the groove.

4. The device as claimed in claim 3, wherein the shaft of the disk extends eccentrically from one of two opposite surfaces of the disk.

5. The device as claimed in claim 1, wherein a curve flexible plate has a first end fixed to an inside of the case and a second end of the flexible plate connected to the second end of the bimetallic plate.

6. The device as claimed in claim 5, wherein the second end of the bimetallic plate has a through hole and the second end of the flexible plate is securely engaged with the through hole.

7. The device as claimed in claim 5, wherein an adjusting bolt is threadedly connected to a block and the first end of the flexible plate has a notch with which the adjusting bolt is engaged.

* * * * *